US005814349A

United States Patent [19]

Geus et al.

[11] Patent Number: 5,814,349

[45] Date of Patent: Sep. 29, 1998

[54] APPARATUS FOR THE CONTINUOUS PRODUCTION OF A SPUN-BOND WEB

[75] Inventors: Hans Georg Geus, Niederkassel-Rheidt; Detlef Frey, Niederkassel; Sebastian Sommer, Troisdorf, all of Germany

[73] Assignee: Reifenhauser GmbH & Co. Maschinenfabrik, Troisdorf, Germany

[21] Appl. No.: 857,008

[22] Filed: May 15, 1997

[30] Foreign Application Priority Data

May 21, 1996 [DE] Germany ..... 196 20 379.1

[51] Int. Cl.[6] ..... B29C 55/000

[52] U.S. Cl. ..... 425/66; 425/72.2; 425/135; 264/210.8; 264/176.1

[58] Field of Search ..... 264/210.8, 176.1; 425/66, 72.2, 135

[56] References Cited

U.S. PATENT DOCUMENTS

| | | | |
|---|---|---|---|
| 3,773,483 | 11/1973 | Schmidt | 264/210.8 |
| 5,211,903 | 5/1993 | Reifenhauser | 264/210.8 |
| 5,460,500 | 10/1995 | Geus et al. | 264/210.8 |
| 5,503,784 | 4/1996 | Balk | 264/210.8 |

FOREIGN PATENT DOCUMENTS

| | | | |
|---|---|---|---|
| 4014989 | 11/1991 | Germany | 425/72.2 |
| 44 14 277 | 8/1995 | Germany . | |
| 43 12 419 | 2/1996 | Germany . | |

*Primary Examiner*—Jay H. Woo
*Assistant Examiner*—Robert Hopkins
*Attorney, Agent, or Firm*—Herbert Dubno

[57] ABSTRACT

An apparatus for the continuous production of spun-bond web separates the in-lowing process air section including the aerodynamic drawing shaft at which the thermoplastic filaments form a spinneret are drawn, from the depositing section in which the filaments are passed through a diffusor and deposit in an entangled form as spun-bond web on a perforated sieve belt. The suction below the belt and the process air blower are independently controlled as part of the separation and the drawing channel forms an air lock while an air inlet gap is provided between the drawing channel and the inlet of the diffusor to further separate the two sections. The resulting apparatus has a high versatility with all products made and materials which can be used.

10 Claims, 3 Drawing Sheets

APPARATUS FOR THE CONTINUOUS PRODUCTION OF A SPUN-BOND WEB

FIELD OF THE INVENTION

Our present invention relates to an apparatus for the continuous production of a spun-bond web of thermoplastic aerodynamically stretched filaments and, more particularly, an apparatus of this type in which the thermoplastic filament curtain extruded from a spinneret descends through a stretching shaft and then enters a diffusor from which the filaments are deposited on an endless perforated or sieve belt below which air is evacuated so that the interentangled filaments form the spun-bond web.

BACKGROUND OF THE INVENTION

Apparatus for the continuous production of spun-bond webs from aerodynamically-stretched filaments of thermoplastic synthetic resin can include, as has been noted, a spinneret and a blower system for supplying process air to a stretching system or unit which has a drawing channel or shaft in which the filaments are entrained downwardly by the process air and are thereby stretched.

In a conventional arrangement, the filaments, after stretching, enter a filament-depositing unit which can include a diffusor which converges downwardly to the diffusor mouth located somewhat above a moving perforated or otherwise air-permeable endless belt on which the web is deposited. In the diffusor, the air velocity drops as the diffusor widens and the curtain of filaments becomes interentangled so that at the mouth the interentangled filaments lie upon the belt to form the spun-bond web. The belt is usually driven continuously.

It has been found that better conditions for deposition of the filaments in the spun-bond web occur when the region in which the deposition takes place is confined. Accordingly, a first pair of pressing rollers may be provided ahead or upstream of the diffusor with respect to the direction of travel of the belt and the web while a second pressing roller pair can engage the web on the belt and the belt immediately downstream of the diffusor mouth.

Furthermore, the uniform deposition of the filaments on the belt can be ensured by providing a suction blower which draws air through the belt and a suction shaft below the belt through which the air is drawn.

In this system, process air from the stretching system may pass into the deposition system. The apparatus is generally closed against the incursion of external air from the spinneret to the belt, except for the process air supplied and any other air which may be fed into the system by blowers or the like. There are, therefore, no regions in which the filaments can be contacted by free ambient air from the environment around the apparatus.

The apparatus is capable of controlling the degree of stretch to the filaments which the composition of the filaments may require and the filament density can be determined by adjustment of the belt speed, the filament extrusion rate and the like to vary within whatever range is desired for particular product characteristics. Indeed, the apparatus must be flexible so as to accommodate a wide range of product requirements and synthetic resin materials used.

In DE 43 12 419, a conventional separation of the stretching system and the deposition system has been proposed. This apparatus provides directly below the spinneret, a cooling chamber which opens into a drawing channel. The drawing channel has a channel width which is by a factor of 0.9 to 0.01 smaller than the smallest cross section formed by the intermediate channel constituting this cooling zone. At the outlet of the drawing channel or shaft, there is a step. The drawing channel or shaft is, in this system, a box-like structure with nozzle-forming walls of sheet metal and in which deformation of the walls of the drawing passage can occur by aerostatic pressure which must be compensated by the control of internal pressure within the unit.

The diffusor is connected to this drawing passage or channel and has a venturi-like inlet which can have an opening communicating with the ambient air so that by the venturi effect, air is sucked into the diffusor.

The flow of air through the diffusor is controlled by the suction blower beneath the sieve belt and the latter, therefore, thus controls the amount of ambient air which is sucked into the system by the venturi nozzle.

While this apparatus has been found to be very effective, it has certain lacks with respect to the flexibility in matching different operating conditions for a particular product to be made. In other words, while excellent results can be obtained, it was difficult in many cases to adjust the apparatus to produce particular products or qualities in a particular product. The same applies to the apparatus described in DE 44 17 277 C1. There is a practically fixed relationship here between the process air velocity and the spun-thread velocity in the drawing channel and thus a limitation in the flexibility of the apparatus.

OBJECTS OF THE INVENTION

It is, therefore, the principal object of the present invention to provide an apparatus for the production of a spun-bond web continuously from aerodynamically stretched thermoplastic filaments in which the apparatus can be used to provide a wide range of products and, in particular, the apparatus is flexible with respect to the products made and the materials which can be handled in the apparatus.

Another object of the invention is to provide an improved apparatus for the purposes described which allows the operating conditions within the apparatus to be varied in a sufficiently wide range of relationships to accommodate a large variety of materials and for the production of a wide range of products without the limitations characterizing earlier spun-bond production systems.

A further object of the invention is to eliminate drawbacks of earlier apparatus and especially limitations as to the variety of products which can be made and materials which can be handled.

SUMMARY OF THE INVENTION

These objects are attained, in accordance with the invention, in an apparatus of the type described in which, in addition, there is a functional separation of the stretching system from the filament- deposition system and:

1.1 the process air blower and the suction blower are controllable or regulatable independently from one another, 1.2 the drawing channel or shaft is, with respect to the gap width, formed as a flow-blocking air shaft or lock which decouples the deposition system from the stretching system aerodynamically, and 1.3 the ambient air inlet gap is adjustable as to the gap thickness or gap width.

The apparatus has increased flexibility with respect to the product-dependent operating conditions in that the gap thickness or width of the ambient air inlet gap and the suction power of the suction blower can be so adjusted that a static pressure is maintained in the diffusor above the sieve belt and in the outflowing suction air which differs only slightly from the static pressure of the ambient air. Furthermore, the suction air mixes with ambient air entering through the inlet gap in the diffusor to give rise to a deceleration therein which avoids the formation of skeins in the descending curtain of filaments.

In other words, as to this latter point, the admission of the ambient air from the exterior to the air in the diffusor which is under the suction force from beneath the perforated belt, is such as to decelerate the air flow and prevent the entanglement of the filaments of the curtain before they reach the deposition surface or the belt that they tend to form ropes or skeins which may cause nonuniformity of the deposited spun-bond web.

More specifically, an apparatus for the continuous production of spun-bond web can comprise:

a spinneret producing a curtain of thermoplastic strands;

cooling means below the spinneret and including a process-air blower and means for blowing process air onto the curtain of strands for cooling same to form thermoplastic filaments;

a stretching system receiving the thermoplastic filaments and including at least one vertical drawing channel and traversed downwardly by the thermoplastic filaments and in which the thermoplastic filaments are aerodynamically entrained by the process air for aerodynamic stretching of the thermoplastic filaments;

a web-depositing system below the channel and including a downwardly diverging diffusor having, at a lower end, a mouth at which a web of interentangled thermoplastic aerodynamically stretched filaments is deposited, process air from the channel passing into the diffusor;

a continuously circulating sieve belt having a web-receiving stretch moving in a direction of advance below the mouth for collecting the interentangled thermoplastic aerodynamically stretched filaments and forming a web therefrom and displacing the web in the direction away from the mouth;

means forming an air inlet gap between a lower end of the channel and an upper end of the diffusor communicating with the atmosphere and admitting ambient air into the upper end of the diffusor;

a first pressing roller pair upstream of the diffusor in the direction and engaging the belt;

a second pressing roller pair downstream of the diffusor in the direction and engaging the belt and the web;

means forming a suction shaft between the first and second roller pairs below the web-receiving stretch and provided with a suction blower for drawing air downwardly in the diffusor and drawing the thermoplastic aerodynamically stretched filaments against the belt; and means for functionally separating the stretching system from the web-depositing system and including:

separate controls for the process-air blower and the suction blower for controlling same independently of one another, dimensioning of the channel so that at the gap the channel forms an air lock shaft aerodynamically decoupling the stretching system from the web-depositing system, and means at the gap for controlling a gap width thereof whereby for operational flexibility, a suction power of the suction blower and the gap width are varied in accordance with product-dependent conditions, a static pressure of air sucked through the diffusor above the belt stretch differs only slightly from ambient pressure, and ambient air entering the diffusor through the gap and mixing with air in the diffusor avoids a skein-forming deceleration.

The invention is based upon our discovery that a precondition for the objects of this invention is set forth above and as solution for the problem attacked by the invention, is a clean functional separation between the stretching system and the deposition system. The invention achieves this functional separation by a combination of the features 1.1, 1.2 and 1.3 set out above and the thereby achieved parameters for operating the unit.

By providing an air lock shaft, according to the invention, we mean to indicate that the apparatus is so operated that process air continuously passes from the drawing channel into the diffusor with a volume rate of flow and a kinetic energy which operates to prevent substantial pressure changes in the deposition system arising from the aerodynamic conditions in the stretching system and the blowing-in unit of the cooling zone. The converse is also true, namely, that the conditions in the deposition system do not effect the aerodynamic conditions in the stretching system.

As a consequence, the blowing-in system, including the aerodynamic stretching portion of the apparatus and the cooling portion thereof can be optimized without any effect on this optimization upon the deposition process and thus without any detrimental effect on the spun-bond web formation.

This precondition is the basis of the high flexibility of the apparatus of the invention, enabling the fabrication of different products from different materials. The flexibility is enhanced when the static pressure in the diffusor is controlled so that a skein formation of the filaments is avoided in the diffusor, i.e. the deceleration in the diffusor does not give rise to such skein formation.

The drawing channel can converge, in vertical section, in a wedge-like manner toward the diffusor inlet. Between the outlet of the blowing-in system and the inlet to the drawing shaft, an intermediate channel can be provided. The intermediate channel, in which the spun filaments are cooled, can run from the outlet of the blowing-in system to the inlet of the drawing shaft with a decreasing width which converges wedge-shaped to the inlet width of the drawing channel. These features tend to buttress the functional separation of the blowing-in system from the diffusor system.

It has been found to be advantageous, moreover, also in support of a functional separation of the two systems that the drawing channel has as its lower end at which it adjoins the ambient air inlet gap, sharp-edged terminations or boundaries. It has been found to be advantageous from an aerodynamic point of view that the ambient air inlet gap opens into the diffusor over rounded inlet bars. The diffusor also should be sharp-edged at its mouth or lower end and the mouth should lie directly above the collecting belt which should be straight and horizontal.

The diffusor-forming side walls can be adjustable relative to one another and, preferably, relative to a median plane of the diffusor symmetrically or asymmetrically. The diffusor angle and the symmetry thereof is thus adjustable. Furthermore, the passage width of the drawing shaft can be adjustable in a similar manner. The end of the drawing shaft and the inlet of the diffusor can be adjustable in a horizontal plane, in a vertical plane, or in both of these planes. The mechanisms for such adjustment can be in a servomechanism commonly used in modern control technology.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
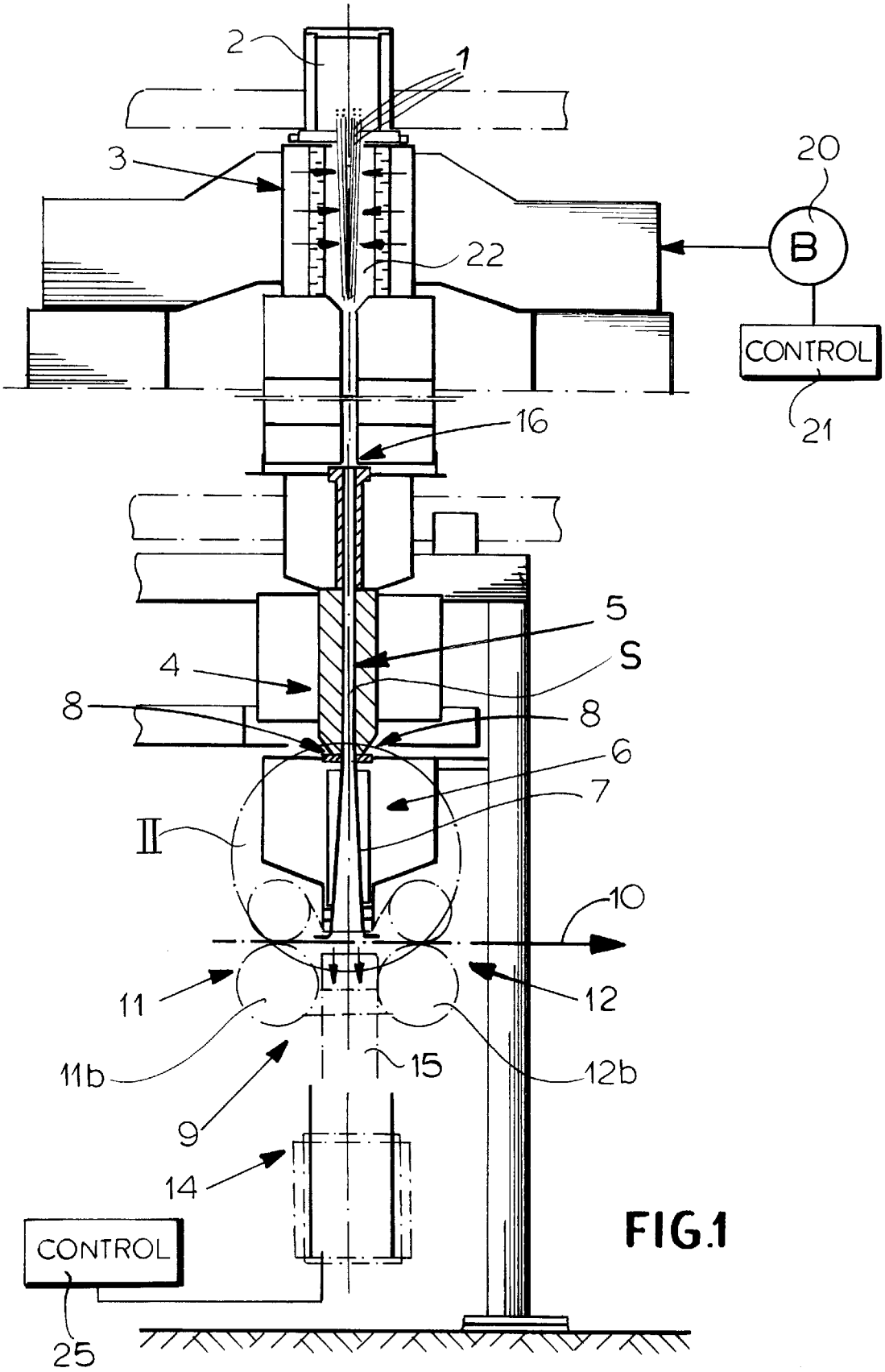
FIG. 1 is a vertical cross section through the apparatus of the invention in a highly diagrammatic form.

The apparatus shown in the drawing serves for the continuous production of a spun-bond web from aerodynamically stretched filaments of a thermoplastic synthetic resin. The filaments 1 emerge as a curtain from the spinneret 2 and are contacted with process air which is blown into the unit by a blowing-in system 3 which can have a blower 20 with its own control 21 allowing independent adjustment of this blower. From the cooling zone 22 of the blowing-in system the curtain passes via an intermediate channel 16 to a stretching system 4 with a stretching shaft or channel 5 and then into the deposition system 6 with its diffusor 7 and the continuous endless belt 10 through which suction is applied by the suction unit 9 and the suction blower 14.

An ambient air inlet gap 8 is provided between the drawing channel 5 and the diffusor 7.

The apparatus also includes a first pressing roller pair 11 at an upstream side of the diffusor mouth 23 and a pressing roller pair 12 at the downstream side of the mouth 23, the upstream pressing roller pair 11 pressing against the belt 10 while the downstream pair presses against both the belt 10 and the spun-bond web which forms thereon.

Figure 2:
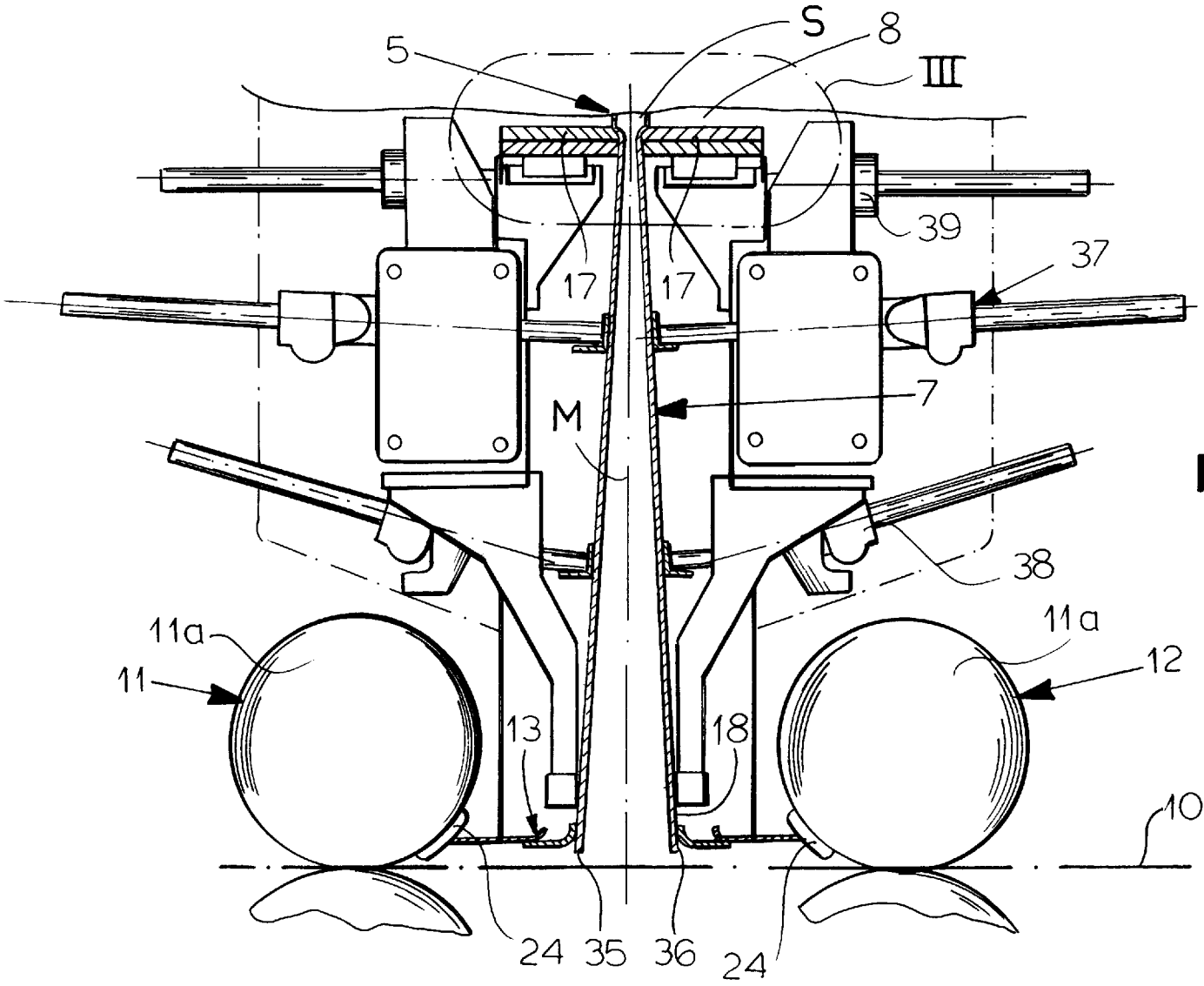
FIG. 2 is a view greatly enlarged in scale of the region II of FIG. 1.

The upper rollers 11*a* and 12*a* of the roller pairs 11 and 12 are sealed with respect to the lower ends of the diffusor via bridges 13 of mutually overlapping strips enabling the defacer walls to be spread apart further or to be moved closer together as will be described. Sealing shoes 24 of the bridges 13 ride on the rollers 11*a* and 12*a* (FIG. 2).

In other words, between the diffusor 7 and the upper pressing roller 11*a* or 12*a* a respective seal is provided. Below the sieve belt 10 is a suction blower 14 as has been mentioned with its own control 25 operable independently of the control 21 to draw air through a suction shaft 15 located between the lower rolls 11*b* and 12*b* of the upstream and downstream pairs 11 and 12. The process air cools the filament curtain in the blowing-in system and emerges from the stretching system 4 to pass into the deposition system 6. The suction through the belt 10 assists in depositing of the spun-bond thereon.

For the functional separation of the stretching system 4 from the deposition system 6, special efforts must be taken in accordance with the invention.

Firstly, the blower 20 and the blower 14 must be independently controllable or regulatable form one another and that is achieved via the separate and distinct controls 21 and 25 which allows these blowers to have volume rates of flow which are independent.

Secondly, the drawing channel is formed, with reference to the gap width, as an air lock shaft S, namely, a shaft which blocks the reverse flow of air so that the deposition system 6 is aerodynamically segregated from the stretching system 4. The air lock shaft S functions as has been described.

Thirdly, the ambient air inlet gap 8 has its gap width adjustable.

Because of this combination of features, the operating conditions can be controlled to provide a high level of flexibility with respect to the products made and the material used. The gap width of the ambient air inlet gap 8 and the suction power of the blower 14 are so adjusted that in the diffusor 7 above the sieve belt 10 a static pressure of the outflowing suction air is established which does not deviate significantly from the static pressure of the ambient air. Preferably the static pressure is ±0.1 to 0.3 bar within the ambient atmosphere pressure. In most cases, ambient air will be drawn in from the gap 8 and will mix with suction air in the diffusor 7. In these cases, the suction air is made up of partial streams from the ambient air inlet gap and process air., the two being proportioned so that the deceleration within the diffusor does not cause skein formation of the filaments, but rather the filaments are permitted without premature intertangling to entangle and deposit on the perforated conveyor surface 10.

From FIG. 1 it will be apparent that the drawing channel 5 can converge in a wedge shape in vertical cross section downwardly although this downward convergence, because of scale, may not be fully apparent in the drawing. Between the outlet of the blowing in system 3 and the inlet of the drawing channel 5, the intermediate channel 16 may be provided and this also should converge downwardly in a wedge shape from the outlet of the cooling portion 22 to the inlet to the drawing channel 5.

Figure 3:
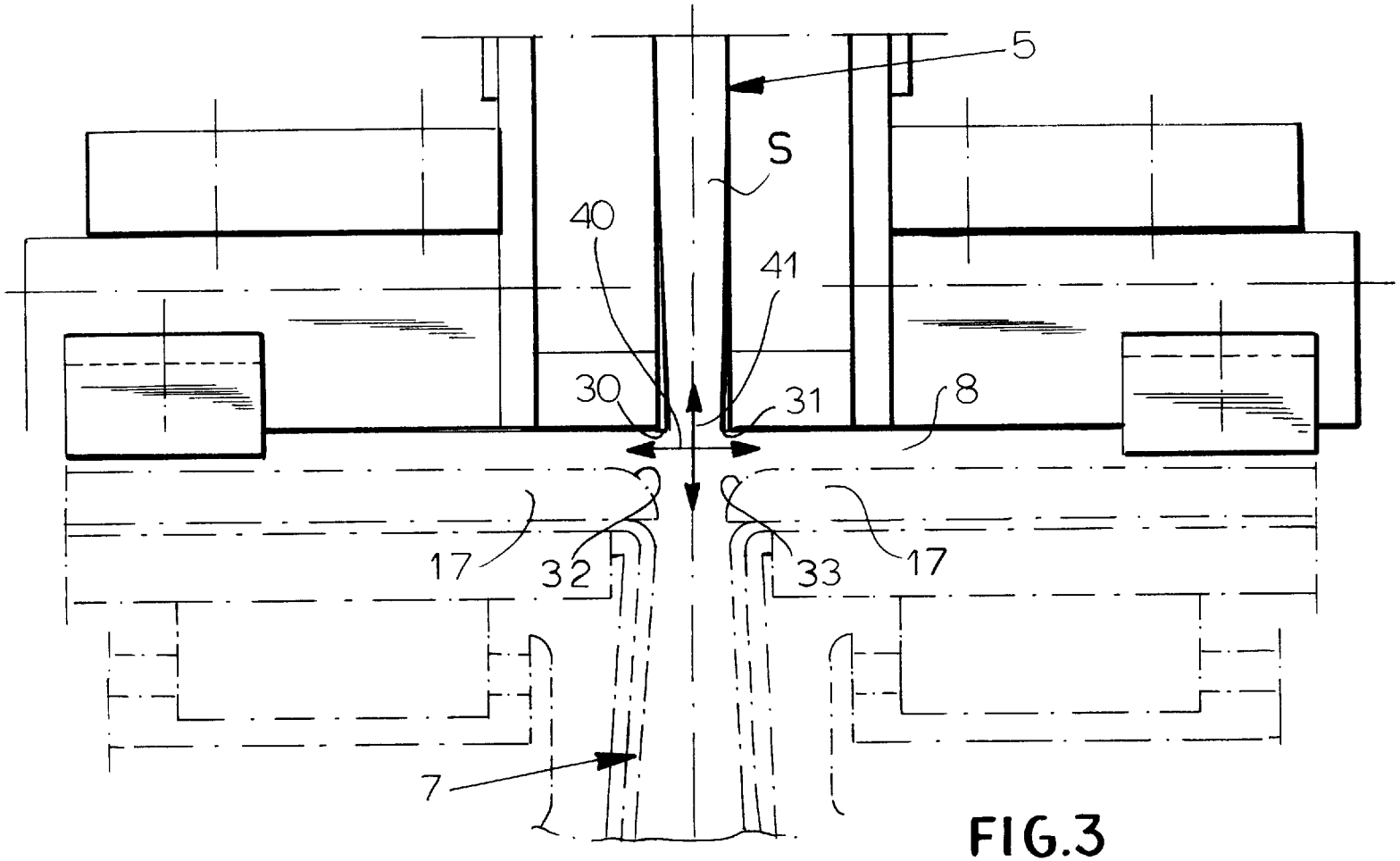
FIG. 3 is a detail view also greatly enlarged in scale of the region III of FIG. 2.

The drawing channel 5 ends with sharp edges in the region of the ambient air inlet passage, these edges being represented at 30 and 31 in FIG. 3.

From FIG. 3 it will also be apparent that the ambient air inlet gap 8 opens via rounded bars 17 into the diffusor 7, the rounded portions being represented at 32 and 33. The diffusor 7, moreover, terminates at sharp edges at the mouth 23 above the sieve belt 10 (see FIG. 2) where these sharp edges are shown at 35 and 36, respectively.

FIG. 2 shows that the diffusor-forming side walls 18 are adjustable, e.g. via servomechanism units 37, 38 and 39, respectively so that these walls can be moved symmetrically or asymmetrically with respect to the median plane M to adjust the diffusor angle or width of the diffusor passage. Similar servo units can be used to control the width of the channel 5.

In FIG. 3, double-headed arrows 40 and 41 show that the end of the drawing channel 5 and the inlet of the diffusor 7 can be adjusted in the horizontal and vertical planes or both.

We claim:

1. An apparatus for the continuous production of a spun-bond web of thermoplastic aerodynamically stretched filaments, comprising:

a spinneret producing a curtain of thermoplastic strands;

cooling means below said spinneret and including a process-air blower and means for blowing process air onto said curtain of strands for cooling same to form thermoplastic filaments;

a stretching system receiving said thermoplastic filaments and including at least one vertical drawing channel and traversed downwardly by said thermoplastic filaments and in which said thermoplastic filaments are aerodynamically entrained by the process air for aerodynamic stretching of said thermoplastic filaments;

a web-depositing system below said channel and including a downwardly diverging diffuser having, at a lower end, a mouth at which a web of interentangled thermoplastic aerodynamically stretched filaments is deposited, process air from said channel passing into said diffuser;

a continuously circulating sieve belt having a web-receiving stretch moving in a direction of advance below said mouth for collecting the interentangled thermoplastic aerodynamically stretched filaments and forming a web therefrom and displacing said web in said direction away from said mouth;

means forming an air inlet gap between a lower end of said channel and an upper end of said diffuser communicating with the atmosphere and admitting ambient air into said upper end of said diffuser, a path of said curtain from said spinneret to said web being closed from the ambient atmosphere except for said means forming said air inlet gap and said process air blower;

a first pressing roller pair upstream of said diffuser in said direction and engaging said belt;

a second pressing roller pair downstream of said diffuser in said direction and engaging said belt and said web;

means forming a suction shaft between said first and second roller pairs below said web-receiving stretch and provided with a suction blower for drawing air downwardly in said diffuser and drawing said thermoplastic aerodynamically stretched filaments against said belt; and means for functionally separating said stretching system from said web-depositing system and including:

separate controls for said process-air blower and said suction blower for controlling same independently of one another, dimensioning of said channel so that at said gap said channel forms an air lock shaft aerodynamically decoupling said stretching system from said web-depositing system, and means at said gap for controlling a gap width thereof whereby for operational flexibility, a suction power of said suction blower and said gap width are varied in accordance with product-dependent conditions, a static pressure of air sucked through the diffuser above said belt stretch differs only slightly from ambient pressure, and ambient air entering the diffuser through said gap and mixing with air in the diffuser avoids a skein-forming deceleration.

2. The apparatus defined in claim 1 wherein the drawing channel converges downwardly toward an inlet of said diffusor in a wedge shape in a vertical section.

3. The apparatus defined in claim 1 wherein between an outlet of said cooling means and an inlet of said drawing channel an intermediate channel is provided.

4. The apparatus defined in claim 3 wherein said intermediate channel converges downwardly in a wedge shape to an inlet width of said drawing channel in vertical section.

5. The apparatus defined in claim 1 wherein said drawing channel terminates at a lower end in a region of said air inlet gap in sharp edges.

6. The apparatus defined in claim 1 wherein said inlet gap opens into an inlet of said diffusor over rounded inlet bars.

7. The apparatus defined in claim 1 wherein said diffusor is formed with sharp edges above said sieve belt.

8. The apparatus defined in claim 1, further comprising means for adjustably shifting side walls of said diffusor relative to each other.

9. The apparatus defined in claim 1, further comprising means for adjusting the width of said drawing channel.

10. The apparatus defined in claim 1 wherein a lower end of said drawing channel and an inlet of said diffusor are adjustable in at least one of the horizontal and vertical planes.

* * * * *